United States Patent [19]

Monson et al.

[11] Patent Number: 5,018,785

[45] Date of Patent: May 28, 1991

[54] FOLDING TABLE

[76] Inventors: Robert J. Monson, 3432 Lyndale Ave. South, Minneapolis, Minn. 55408; Alan L. Dzubak, 3501 Tyler St. NE., Minneapolis, Minn. 55418

[21] Appl. No.: 441,990

[22] Filed: Nov. 28, 1989

[51] Int. Cl.[5] ..... A47B 3/14

[52] U.S. Cl. ..... 297/159; 108/113

[58] Field of Search ..... 297/159, 157, 141, 134, 297/121; 108/113, 35, 36

[56] References Cited

U.S. PATENT DOCUMENTS

| | | | |
|---|---|---|---|
| 769,354 | 9/1904 | Nielsen . | |
| 1,514,418 | 11/1924 | Battenfeld . | |
| 1,873,484 | 9/1931 | Blumenthal | 297/159 |
| 2,421,127 | 5/1947 | Peckham . | |
| 2,502,502 | 4/1950 | Bennett | 297/159 X |
| 2,548,682 | 4/1951 | Price . | |
| 3,256,037 | 6/1966 | Giambalvo . | |
| 3,259,426 | 7/1966 | Shaw et al. . | |
| 3,994,527 | 11/1976 | Nikitits et al. . | |
| 4,131,311 | 12/1978 | Nikitits et al. | 297/159 |
| 4,249,773 | 2/1981 | Giambalvo . | |
| 4,700,987 | 10/1987 | Sraka et al. | 297/159 |

FOREIGN PATENT DOCUMENTS

| | | | |
|---|---|---|---|
| 1054748 | 2/1954 | France | 297/139 |

*Primary Examiner*—José V. Chen

*Attorney, Agent, or Firm*—Faegre & Benson

[57] ABSTRACT

A table and attached bench support structure is foldable between an open erected position and a closed storable position. The table support mechanism comprises pivotally interconnected top brace, leg brace, bench leg, bench support member and table leg cooperating together to support both the table top and the bench seats. The table and bench mechanism may fold together for storage of the table, or the benches may be removed and the table separately folded for storage. The volume of the folded table is approximately one-eighth the volume of the fully erected table.

16 Claims, 5 Drawing Sheets

52
54
50
42
48
70
68
22
44
46
41
60
80
62
58
24
56
76
74
40
72
78
64
66
65
20
34
30
26
32

54
50
52
48
70
60
68
42
24
62
22
58
44
56
46
80
72
74
20
76
41
64
30
34
40
26
66
65
32

20
50
52
54
48
42
60
68
62
58
56
80
22
70
72
74
44
76
64
24
66
65
34
38
40
41
46
26
32

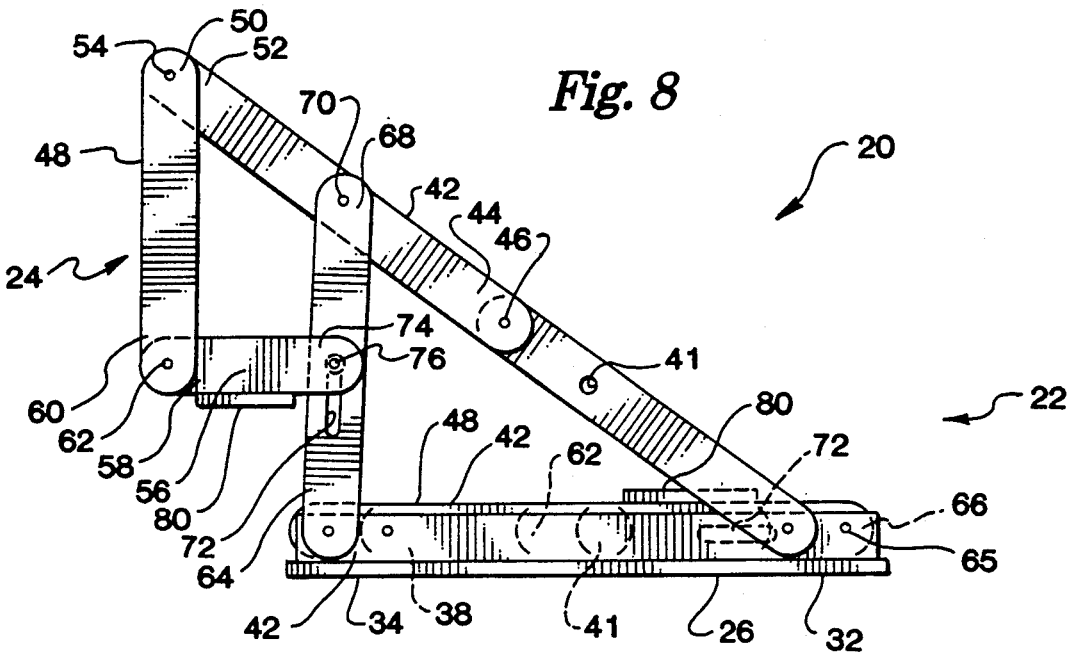
Fig. 8
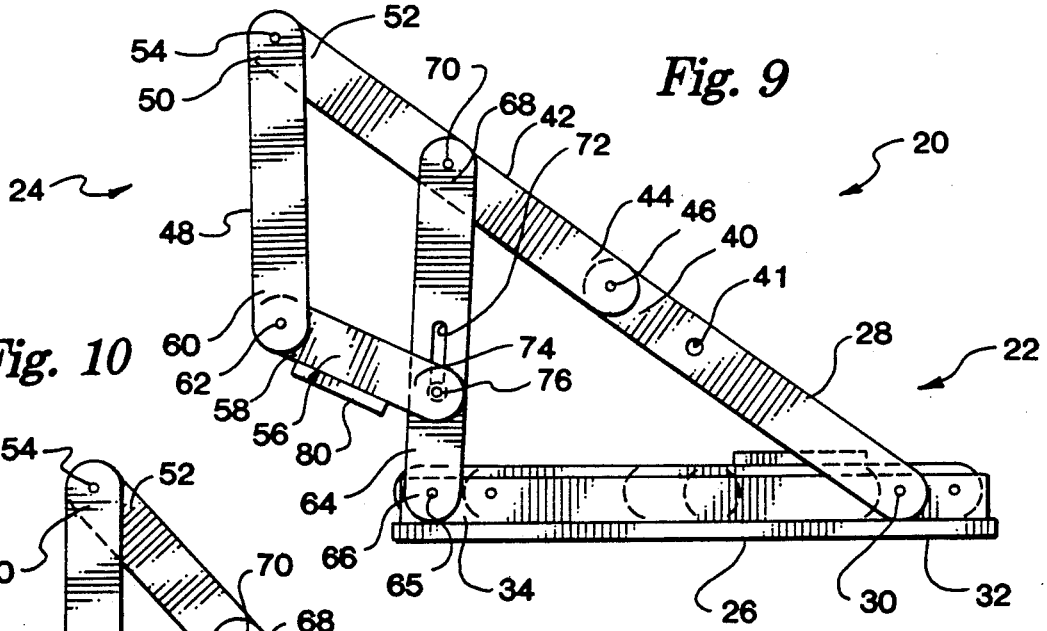
Fig. 9
Fig. 10
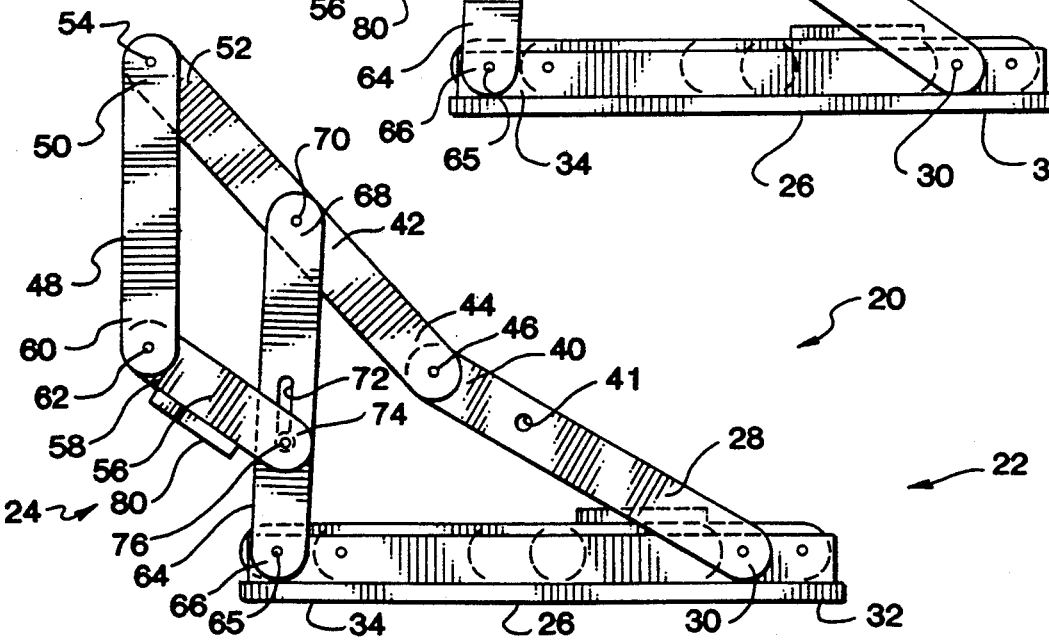

FOLDING TABLE

BACKGROUND OF THE INVENTION

The present invention provides a foldable table and bench support assembly. More especially, this invention provides a unique device which can readily be set up into its open usable position without the need for special tools or manipulations, and then simply folded into its compact closed position for space-saving storage or easy transportation until again needed. To provide the greatest strength and rigidity to the present folding table, the table top is designed as a single element. Thus, when the present table is in its folded storable position, its largest dimension is no more than that of the table surface. The overall volume of the folded table is approximately one-eighth that of the open volume, so that it is an extremely compact, space-efficient design.

In order to further enhance the compactness of the folded position of the present table, the longest support leg or link, that supporting both the table top and the bench, is jointed in the center, allowing this longest link to fold for storage. The force on this link is limited only by the shear strength of the retaining key pin, which supportingly retains two of these longest links in their open crossed position.

The design and structure of the present table is strong enough to support at least several persons comfortably and safely, while still being small enough in its folded storable position to be easily carried by a single person. The supporting folding mechanism need only be permanently attached to the table top, while the benches may be either permanently or removably attached. When the table is in its open position, the supporting mechanism does not in any way interfere with full use of the benches and the table top.

SUMMARY OF THE INVENTION

This invention provides a table and attached bench supporting structure foldable between an open usable position and a closed storable position. The table comprises a generally rectangular table top. A top brace is pivotally attached by a first end of each top brace at each of four corners of the table top to form two pairs of top braces which are pivotable towards each other. Each top brace has a key pin retention means intermediate the first and second ends of each top brace.

A leg brace is pivotally attached by a first end of the leg brace to a second end of each top brace to form a knee pivot connecting each leg brace to its top brace. A bench leg is pivotally attached by a first end of the bench leg to a second end of each leg brace to form a base pivot connecting each bench leg to its leg brace. A bench support member is pivotally attached by a first end of the bench support member to a second end of each bench leg to form a bench pivot connecting each bench support member to its bench leg. A table leg is pivotally attached by a first end of the table leg at each of four corners of the table top, each table leg is also pivotally attached at a second end of the table leg to a leg brace at a point between the first and second end of the leg brace to form an intermediate pivot connecting the table leg to its leg brace. Each table leg also has a slidable pivotal attachment intermediate first and second ends of the table leg for slidable pivotal attachment of a second end of the bench support member to form a slidable pivot connecting each table leg to its bench support member.

When the table is in the open useable position, each top brace forms essentially a straight angle with its attached leg brace, each bench support member is essentially parallel with the planar table top, the bench legs and table legs are essentially parallel with each other and are essentially perpendicular to the planar table top, each slidable pivot is in a position towards the second end of each table leg, and each pair of top braces cross each other in X-shape with the corresponding key pin retention means of each top brace pair maintained in registrable alignment with each by a key pin retaining means.

In order to fold the table to the closed storable position, the entire structure is tipped over so that the table is resting on the table top surface. Each slidable pivot is allowed to slide to a position towards the first end of each table leg. The key pin retaining means are disengaged, each top brace pivots at its first end and at its knee pivot, each leg brace pivots at its knee pivot and base pivot so that each pair of top braces folds towards each other. Each bench leg pivots at its base pivot and bench pivot, each bench support member pivots at its bench pivot and slidably pivots at its slidable pivotable attachment means, each table leg pivots at its table pivot and its intermediate pivot, so that the top braces, leg braces, bench legs, bench support members and table legs all fold to a position parallel with, adjacent to and within the perimeter of the table top.

BRIEF DESCRIPTION OF THE DRAWINGS

FIG. 8 is a side elevational view showing the right bench support side of the leg and brace assembly completely collapsed.

FIG. 9 is a side elevational view of the table with the left bench support side in the first collapsing position.

FIG. 10 is a side elevational view of the table with the left bench support side in the second collapsing position.

DETAILED DESCRIPTION OF THE INVENTION

Figure 1:
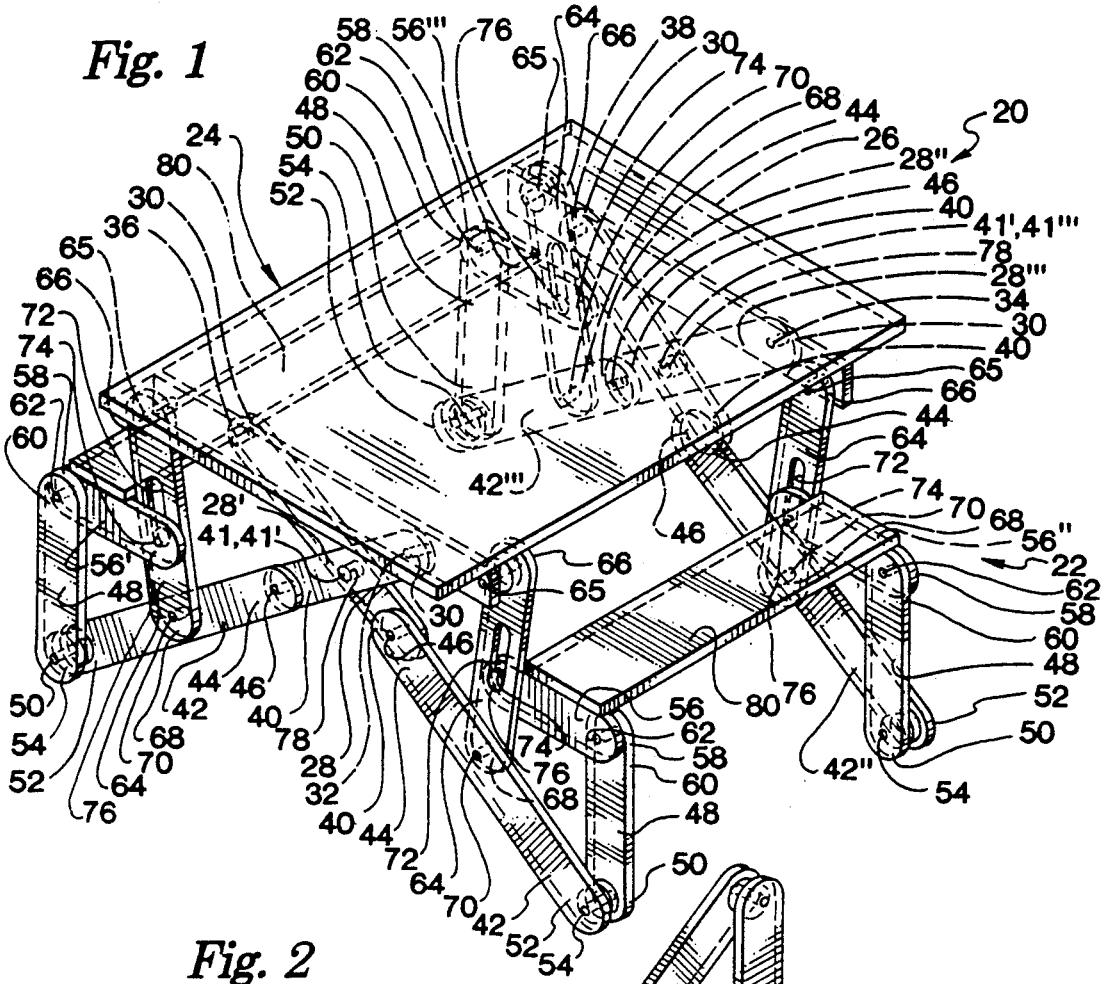
FIG. 1 is a top perspective views of the table of this in its open usable position.
Figure 2:
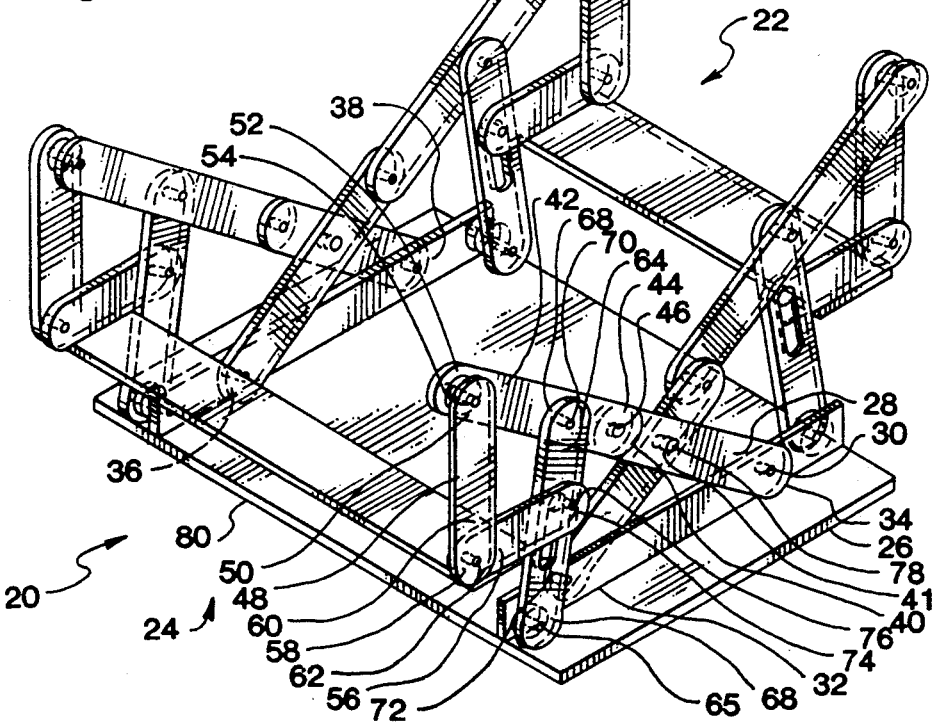
FIG. 2 is a bottom perspective view of the table in its open usable position.
Figure 3:
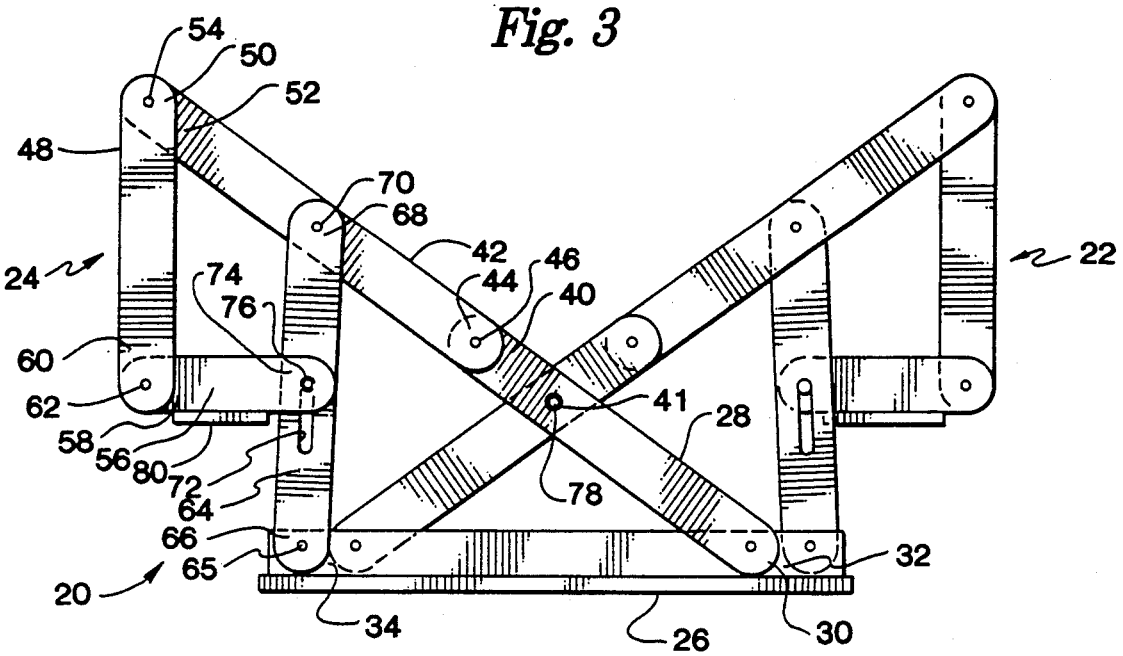
FIG. 3 is a side elevation view of the inverted table before beginning the collapsing process.
Figure 4:
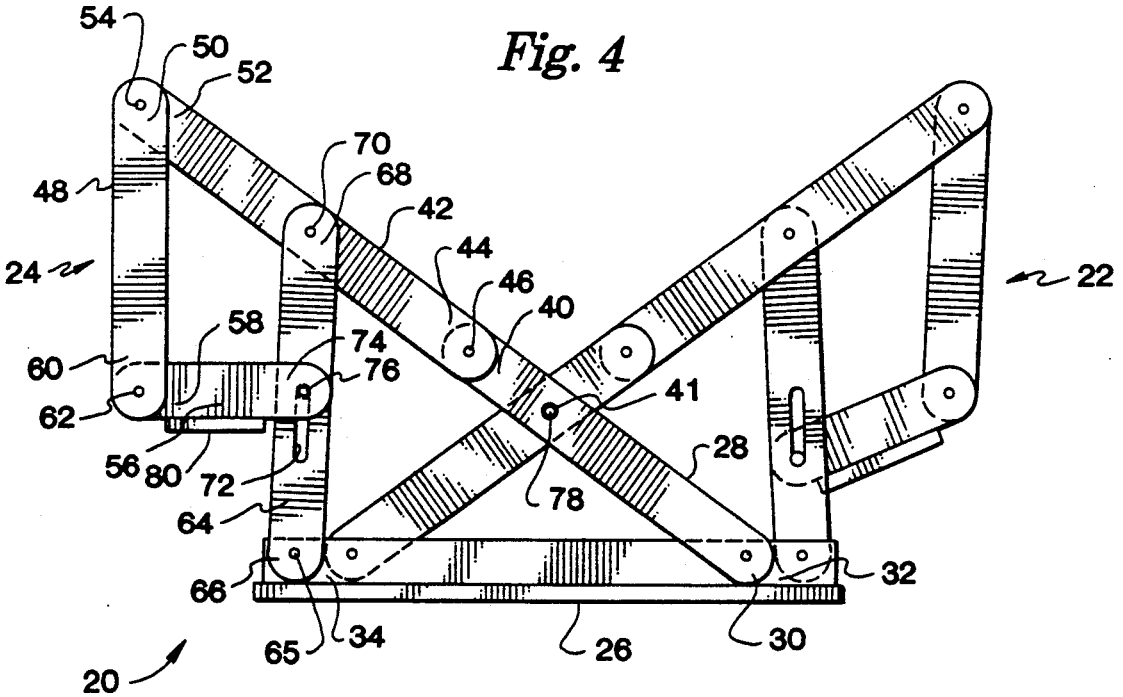
FIG. 4 is a side elevational view of the table with the right bench support side in the first collapsing position.
Figure 5:
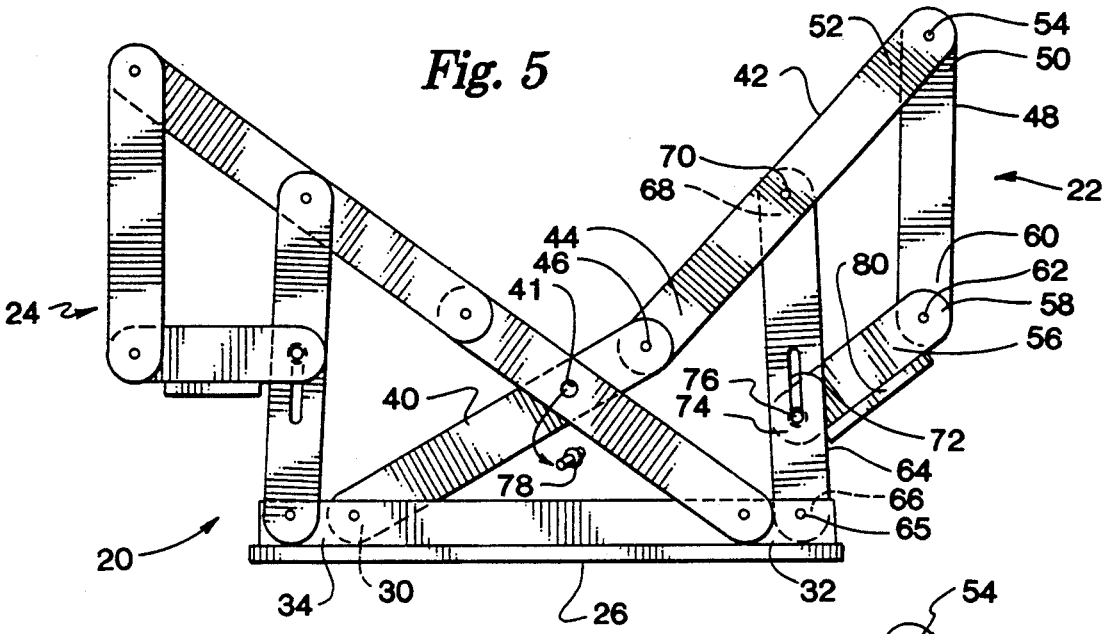
FIG. 5 is a side elevational view of the table with the right bench support side in the second collapsing position.
Figure 6:
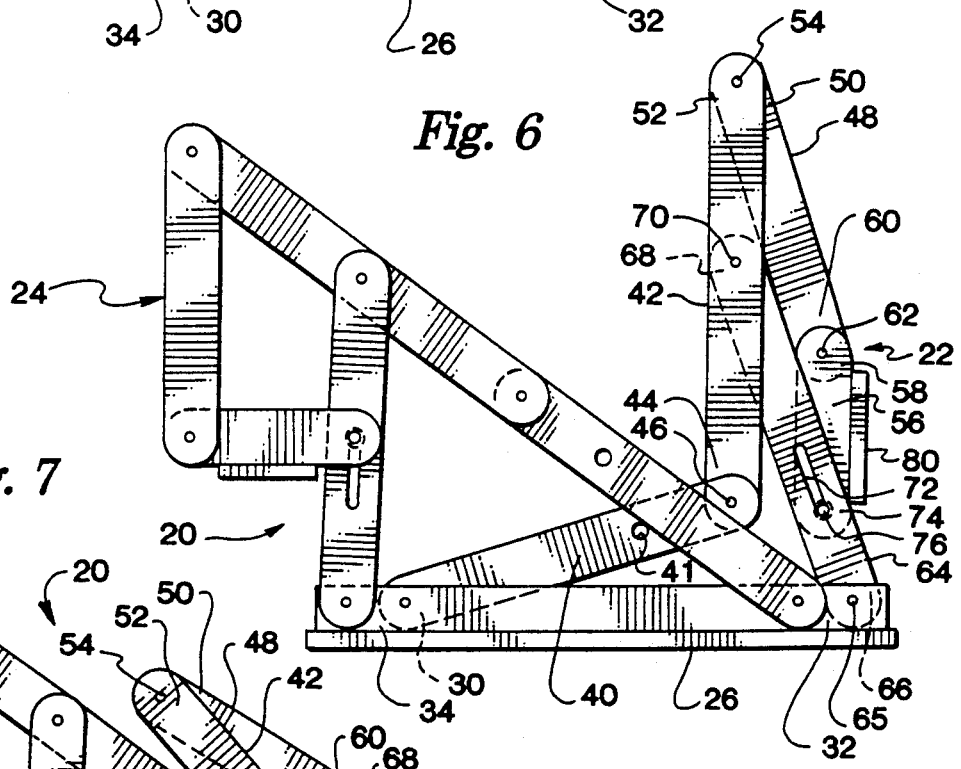
FIG. 6 is a side elevational view of the table with the right bench support side in the third collapsing position.
Figure 7:
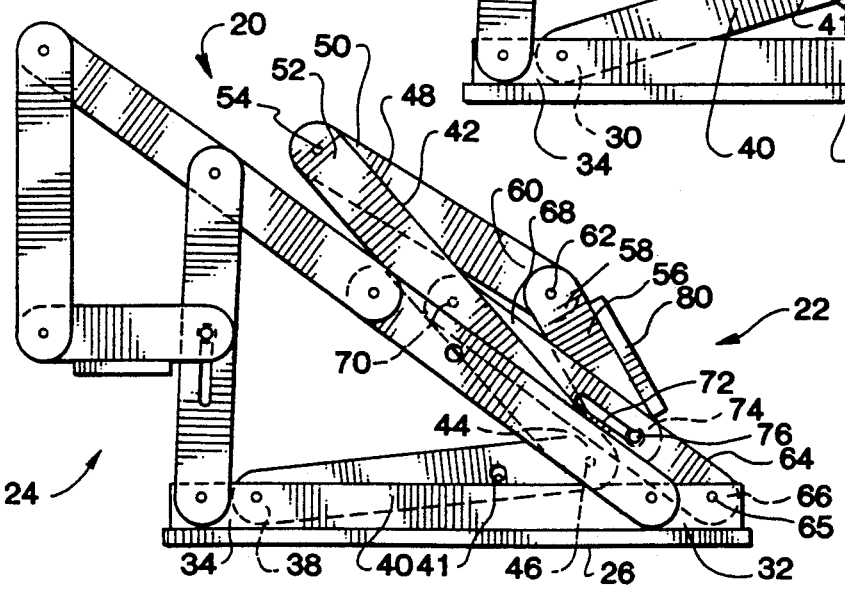
FIG. 7 is a side elevational view of the table with the right bench support side in the fourth collapsing position.
Figure 11:
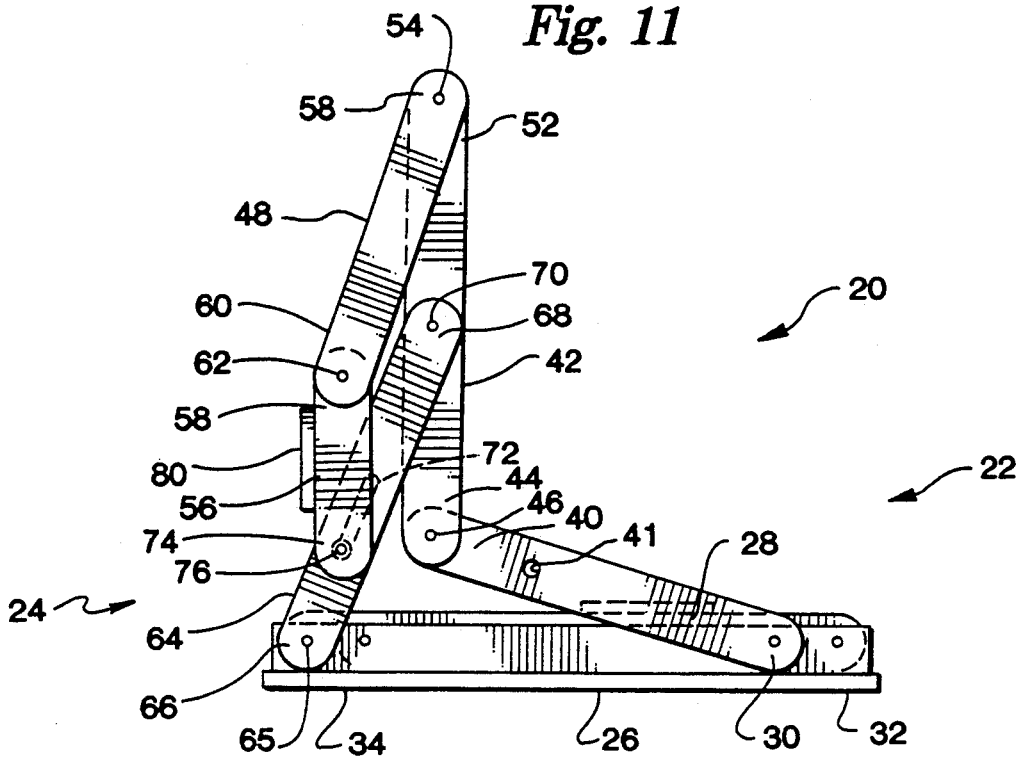
FIG. 11 is a side elevational view of the table with the left bench support side in the third collapsing position.
Figure 12:
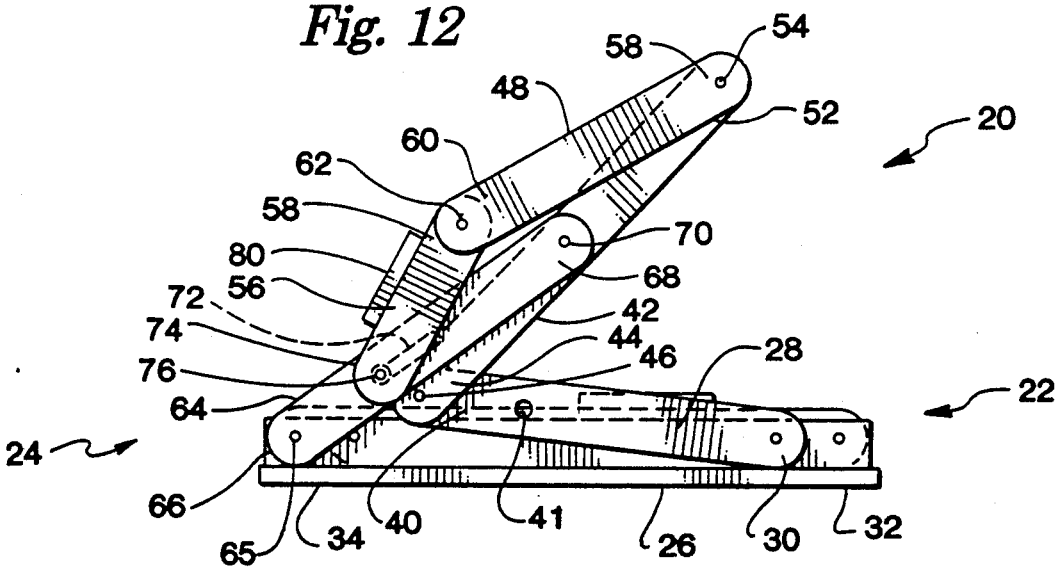
FIG. 12 is a side elevational view of the table with the left bench support side in the fourth collapsing position.
Figure 13:
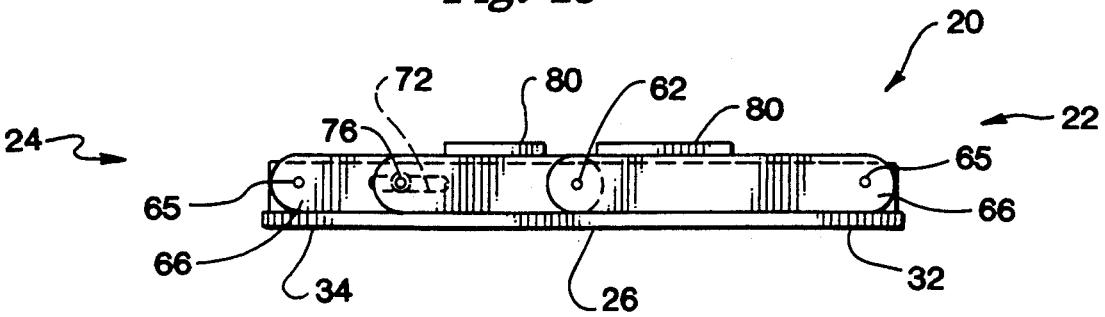
FIG. 13 is a side elevational view of the table with both sides completely collapsed into the closed storable position.

FIGS. 1 through 13 show different view of the table 20 and attached bench 22, 24 support structure of the present invention in various positions between the open erected position, as illustrated in FIGS. 1–3, and the closed storage position, as illustrated in FIG. 13.

The table 20 has a generally planar table top 26, shown in the illustrations as also generally rectangular. A top brace 28 is pivotally attached by a first end of the top brace at each of four rectangularly positioned points 32, 34, 36, 38 of the planar surface of the top 26 to form two pairs of top braces 28, 28′ and 28″, 28‴ positioned opposite each other and pivotable towards each other. Each top brace 28 has a key pin retention means 41 intermediate first 30 and second ends 40 of said top brace 28, illustrated in the Figures as a hole.

A leg brace 42 is pivotally attached by a first end 44 of said leg brace 42 to a second end 40 of each top brace 28 to form a knee pivot 46 connecting each leg brace 42 to a top brace 28. A bench leg 48 is pivotally attached by a first end 50 of said bench leg 48 to a second end 52 of each leg brace 42 to form a base pivot 54 connecting each bench leg 48 to a leg brace 42. A bench support member 56 is pivotally attached by a first end 58 of said bench support member 56 to a second end 60 of each bench leg 48 to form a bench pivot 62 connecting each bench support member 56 to a bench leg 48. A table leg 64 is pivotally attached by a first end 66 of said table leg 64 at each of four rectangularly positioned points 32, 34, 36, 38 of the planar surface of the top 26 to form a table pivot 65. Each table leg 64 is also pivotally attached at a second end 68 of said table leg 64 to a leg brace 42 at a point between the first 42 and second end 52 to form an intermediate pivot 70 connecting each table leg 64 to a leg brace 42. Each table leg 64 also has a slidable pivotal attachment means 72 intermediate the first 66 and second end 68 of the table leg 64 for slidable pivotal attachment of a second end 74 of each bench support member 74 to form a slidable pivot 76 connecting each table leg 64 to a bench support member 56. The point of attachment (32 or 34) of each top brace 28 to the table top 26 is directly opposite the point of attachment (36 or 38, respectively) to the table top 26 of the corresponding table leg 64 to which the top brace 28 is attached through its corresponding bench support member 56, bench leg 48 and leg brace 42.

When the table 20 is in the open erected position, as illustrated in FIGS. 1–3, each top brace 28 forms essentially a straight angle with its attached leg brace 42 at the knee pivot 46. Each bench support member 56 is essentially parallel with the planar table top 26. The bench legs 48 and table legs 64 are essentially parallel with each other and are essentially perpendicular to the planar table top 26. Each slidable pivot 76 is in a position towards the second end 68 of each table leg 64. Each pair of leg braces 42, 42′ and 42″, 42‴ respectively and their attached top braces 28, 28′ and 28″, 28‴ cross each other in X-shape with the corresponding key pin retention means 41, 41′ and 41″, 41‴ respectively of each top brace pair 28, 28′ and 28″, 28‴ respectively maintained in registrable alignment with each other by a key pin 78.

The method of folding the table to the closed storable position is illustrated in FIGS. 4–12, with the completely closed table shown in FIG. 13. It is to be understood that each of these Figures does not represent a discrete step in folding and unfolding the present table, but is merely intended to represent the continuum through which the supporting mechanism passes in being transposed from the open to the closed position. To fold the table 20 to the closed storable position the entire structure is tipped over so that the table is resting on the table top surface. Each slidable pivot 76 is allowed to slide to a position towards the first end 66 of each table leg 64. The key pins 78 are disengaged. Each top brace 28 pivots at its first end 30 and at its knee pivot 46. Each leg brace 42 pivots at its knee pivot 46 and base pivot 54, so that each pair of top braces 28, 28′ and 28″, 28‴ respectively fold towards each other. Each bench leg 48 pivots at its base pivot 54 and its bench pivot 62. Each bench support member 56 pivots at its bench pivot 62 and slidably pivots at its slidable pivotal attachment means 72. Each table leg 64 pivots at its table pivot 65 and its intermediate pivot 70. In the fully closed position illustrated in FIG. 13, the top braces 28, leg braces 42, bench legs 48, bench support members 56 and table legs 64 all fold to a position parallel with, adjacent to and within the four rectangularly positioned points 32, 34, 36, 38 of the planar table top 26.

When the table 20 is in the open erected position, as shown in FIGS. 1–3, the bench support members 56 extend beyond the rectangular plane of the table top 26, with two adjacent bench support members 56, 56′ and 56″, 56‴ respectively each supporting a bench 80.

As shown in the attached Figures, the table legs 64 and top braces 28 are attached to the table top 26 by way of table top supports 82 positioned on opposite parallel sides of the table top 26. The present table 20 may be constructed with the benches 80 as an integral part of the entire table structure or the benches 80 may be removable. As shown in the Figures, the benches 80 are an integral part of the table 20. As thus shown, the table legs 64 on the first bench side 22 of the table 20 are each positioned on the inside of the table top supports 82, and are connected through their corresponding bench support members 56, bench legs 48 and leg braces 42 to top braces 28 which are also positioned on the inside of the table top supports 82. The table legs 64 on the second bench side 24 of the table 20 are each positioned on the outside of the table top supports 82, and are connected through their corresponding bench support members 56, bench legs 68 and leg braces 42 to top braces 28 which are also positioned on the outside of the table top supports 82. Thus, when the bench 80 on the first bench side 22 is permanently attached to the bench support members 56 it can be no longer than the distance between the two adjacent bench support members 56 on the first bench side 22 in order to allow the table support mechanism to properly open and close as shown in the Figures. Also, as shown in the Figures, when the bench 80 on the first bench side 22 is permanently attached to the table 20, the first bench side is folded first in folding the table mechanism so that the top braces 28, leg braces 42, bench legs 48, bench support members 56 and table legs 64 supporting the shorter bench 80 on the first bench side 22 are nested inside the corresponding mechanism supporting the bench 80 on the second longer bench side 24. The bench 80 on the second bench side 86 may be of any desired length and is generally of the same length as the table top 26. Thus, if both benches 80, or at least the bench on the first bench side 22 is removable, both benches can extend the full length of the table 20.

What is claimed is:

1. A table and attached bench support structure foldable between an open erected position and a closed storable position comprising:

a generally planar table top;

a top brace pivotally attached by a first end of said top brace at each of four rectangularly positioned points of a planar surface of the top to form two pairs of top braces pivotable towards each other, each top brace having a key pin retention means intermediate first and second ends of said top brace;

a leg brace pivotally attached by a first end of said leg brace to a second end of each top brace to form a knee pivot;

a bench leg pivotally attached by a first end of said bench leg to a second end of each leg brace to form a base pivot;

a bench support member pivotally attached by a first end of said bench support to a second end of each bench leg to form a bench pivot; a table leg pivotally attached by a first end of said table leg at each of four rectangularly positioned points of said planar surface of the top to form a table pivot, each table leg pivotally attached at a second end of said table leg to a leg brace at a point between the first and second end of the leg brace to form an intermediate pivot, each table leg having a slidable pivotal attachment means intermediate first and second ends of said table leg for slidable pivotal attachment of a second end of each bench support member to form a slidable pivot for longitudinal translation of the second end of the bench support member with respect to a length of the table leg intermediate the first and second ends of the table leg and for pivoting of the second end of the bench support member about a point of attachment of the second end; and a point of attachment of each top brace to the table top being directly opposite a second point of attachment to the table top of the corresponding table leg to which the top brace is attached through its corresponding bench support member, bench leg and leg brace.

2. A table according to claim 1, such that when the table is in the open erected position, each top brace forms essentially a straight angle with its attached leg brace, each bench support member is essentially parallel with the planar table top, bench legs and table legs are essentially parallel with each other and are essentially perpendicular to the planar table top, each slidable pivot is in a position towards the second end of each table leg, and each corresponding pair of leg braces and attached top braces cross each other in X-shape with the corresponding key pin retention means of each top brace pair maintained in registrable alignment with each other by a key pin.

3. A table according to claim 1, such that, to fold the table to the closed storable position, the structure is positioned resting on the table top surface, each slidable pivot is allowed to slide to a position towards the first end of each table leg, the key pins are disengaged, each top brace pivots at its first end and at its knee pivot, each leg brace pivots at its knee pivot and base pivot so that each pair of top braces folds towards each other, each bench leg pivots at its base pivot and bench pivot, each bench support member pivots at its bench pivot and slidably pivots at its slidable pivotal attachment means, each table leg pivots at its table pivot and its intermediate pivot, so that the top braces, leg braces, bench legs, bench support members and table legs all fold to a position parallel with, adjacent to and within the rectangular plane of the table top.

4. A table according to claim 1, wherein when the table is in open usable position, the bench support members extend beyond the rectangular plane of the table top, with two adjacent bench support members supporting a bench.

5. A table according to claim 4, wherein a shorter bench is no longer than a shorter distance between two adjacent bench support members.

6. A table according to claim 5, wherein the benches are permanently attached to the bench support members.

7. A table according to claim 6, wherein, when the table is folded to the closed storable position, the top braces, leg braces, bench legs, bench support members and table legs supporting the shorter bench are foldable into the table top first and nest inside the remaining two top braces.

8. A table according to claim 1, wherein the top braces and the table legs are attached to the table top by means of a table top support.

9. A table and attached bench support structure foldable between an open usable position and a closed storable position comprising:

a generally planar table top;

a table leg pivotally attached by a first end of said table leg at each of four rectangularly positioned points of a planar surface of the top to form two pairs of table legs pivotable towards each other, each table leg having a slidable pivotable attachment means intermediate first and second ends of said table leg;

a bench support member slidable and pivotally attached by a second end of each bench support member to form a slidable pivot for longitudinal translation of the second end of the bench support member with respect to a length of the table leg intermediate the first and second ends of the table leg and for pivoting of the second end of the bench support member about a point of attachment of the second end connecting each bench support member to a table leg;

a bench leg pivotally attached by a second end of said bench leg to a first end of each bench support member to form a bench pivot connecting each bench leg to a bench support member;

a leg brace pivotally attached by a second end of said leg brace to a first end of each bench leg to form a base pivot connecting each leg brace to a bench leg, each leg brace also connected at a point between a first and second end of the leg brace to a second end of a table leg to which the leg brace is connected through its corresponding bench leg and bench support member;

a top brace pivotally attached by a first end of said top brace at each of four rectangularly positioned points of said planar surface of the top to form two pairs of top braces pivotable towards each other, each top brace pivotally attached at a second end of said top brace to a first end of a leg brace to form a knee pivot connecting each top brace to a leg brace, each top brace having a key pin retention means intermediate first and second ends of said top brace; and a point of attachment of each top brace to the table top being directly opposite a second point of attachment to the table top of the corresponding table leg to which the top brace is attached through its corresponding bench support member, bench leg and leg brace.

10. A table according to claim 9, such that when the table is in the open usable position, each top brace forms essentially a straight angle with its attached leg brace, each bench support member is essentially parallel with the planar table top, bench legs and table legs are essentially parallel with each other and are essentially perpendicular to the planar table top, each slidable pivot is in a position towards the second end of each table leg, and each corresponding pair of leg braces and attached top braces cross each other in X-shape with corresponding key pin retention means of each top brace pair maintained in registrable alignment with each other by a key pin.

11. A table according to claim 9, such that, to fold the table to the closed storable position, the entire structure is positioned resting on the table top surface, each slidable pivot is allowed to slide to a position towards the first end of each table leg, the key pin retention means are disengaged, each top brace pivots at its first end and at its knee pivot, each leg brace pivots at its knee pivot and base pivot so that each pair of top braces folds towards each other, each bench leg pivots at its base pivot and bench pivot, each bench support member pivots at its bench pivot and slidably pivots at its slidable pivotal attachment means, each table leg pivots at its table pivot and its intermediate pivot, so that the top braces, leg braces, bench legs, bench support members and table legs all fold to a position parallel with, adjacent to and within the rectangular plane of the table top.

12. A table according to claim 11, wherein when the table is in open usable position, the bench support members extend beyond the rectangular plane of the table top, with two adjacent bench support members supporting a bench.

13. A table according to claim 12, wherein a shorter bench is no longer than a shorter distance between two adjacent bench support members.

14. A table according to claim 13, wherein the benches are permanently attached to the bench support members.

15. A table according to claim 14, wherein, when the table is folded to the closed storable position, the top braces, leg braces, bench legs, bench support members and table legs supporting the shorter bench are foldable into the table top first and nest inside the remaining two top braces.

16. A table according to claim 9, wherein the top braces and the table legs are attached to the table top by means of a table top support.

* * * * *